US010968874B2

(12) United States Patent
Almeida et al.

(10) Patent No.: US 10,968,874 B2
(45) Date of Patent: Apr. 6, 2021

(54) COLLAPSIBLE FOAM SLEEVE FOR ENGINE AIR INDUCTION SYSTEM

(71) Applicant: Ford Global Technologies, LLC, Dearborn, MI (US)

(72) Inventors: Adilson Canovas Almeida, Lauro de Freitas (BR); Antonio Mathias, Salvador (BR)

(73) Assignee: Ford Global Technologies, LLC, Dearborn, MI (US)

( * ) Notice: Subject to any disclaimer, the term of this patent is extended or adjusted under 35 U.S.C. 154(b) by 93 days.

(21) Appl. No.: 16/412,280

(22) Filed: May 14, 2019

(65) Prior Publication Data

US 2020/0362802 A1 Nov. 19, 2020

(51) Int. Cl.
*F02M 35/10* (2006.01)

(52) U.S. Cl.
CPC *F02M 35/10334* (2013.01); *F02M 35/10209* (2013.01)

(58) Field of Classification Search
CPC ..... F02M 35/10334; F02M 35/10209; B29C 2793/0054; B29C 2793/009; B29C 2793/0009; B29C 2793/0018; B29C 67/20
See application file for complete search history.

(56) References Cited

U.S. PATENT DOCUMENTS 3,481,455 A * 12/1969 Graham ..... B65D 81/09 206/523
3,649,398 A * 3/1972 Keith ..... B32B 27/00 156/79
3,766,629 A * 10/1973 Lechtenberg ..... B26D 3/006 29/412
3,796,277 A * 3/1974 Gordon ..... B60R 13/0884 180/68.3
5,133,315 A * 7/1992 Reese ..... F01P 11/12 123/198 E
5,647,255 A * 7/1997 Stone ..... F16J 15/106 277/312
5,722,358 A * 3/1998 Fuesser ..... B60K 13/02 123/184.56
5,744,077 A * 4/1998 Grisch ..... B29C 44/1233 264/46.6
6,237,717 B1 * 5/2001 Osanai ..... B60R 13/0838 181/294
6,413,458 B1 * 7/2002 Pearce ..... A47C 27/15 264/141
7,322,381 B2 * 1/2008 Kino ..... F16L 9/22 123/184.21
8,919,082 B1 * 12/2014 Cataldo ..... B65B 43/08 53/452
8,919,492 B2 * 12/2014 Metzger ..... F02M 35/1266 181/214
2007/0221161 A1 * 9/2007 Khouw ..... F02M 35/10013 123/198 R (Continued)

*Primary Examiner* — Hung Q Nguyen

(74) *Attorney, Agent, or Firm* — Geoffrey Brumbaugh; McCoy Russell LLP

(57) ABSTRACT

Methods and systems are provided for a foam sleeve circumferentially surrounding an engine passage. In one example, a system may include a collapsible foam sleeve including cuts on its surface that may be fit onto the engine passage. The foam sleeve may be stacked and transported in a collapsed state and then expanded prior to the fitting to the engine passage.

20 Claims, 8 Drawing Sheets

(56) References Cited

U.S. PATENT DOCUMENTS

| | | | | |
|---|---|---|---|---|
| 2010/0212797 | A1* | 8/2010 | Eaton ..... | B29D 30/02<br>152/301 |
| 2011/0004137 | A1 | 1/2011 | Cornacchio et al. | |

* cited by examiner

COLLAPSIBLE FOAM SLEEVE FOR ENGINE AIR INDUCTION SYSTEM

FIELD

The present description relates generally to methods and systems for a collapsible foam sleeve coupled to an air induction system passage.

BACKGROUND/SUMMARY

An air induction system enables ambient air to flow to engine cylinders for combustion. The air induction system may include an intake passage housing an air cleaner box including a filter, the intake passage leading to a throttle and an intake manifold. In order to restrict fluidic communication between engine and atmosphere and avert ambient air from to otherwise enter the engine system, an outer wall of the intake passage is sealed within the engine system. A foam sleeve may be included along the outer perimeter of the intake passage opening to improve the sealing and also to reduce engine noise from propagating. In order for the foam sleeve to fit onto the intake passage opening, a hollow cubic foam object with a central opening is manufactured. The foam sleeve may be manufactured by removing foam material from a central core of a foam cube, however, this manufacturing method may cause wastage of a large portion of the foam material.

Various approaches are provided for cutting and manufacturing foam sleeves used in a plurality of engine components. For example, in U.S. Pat. No. 3,766,629 Lechtenberg discloses a foam sleeve-like air filter element cut from a block of foam material. In the relaxed state, the sleeve has a narrow, elongated race track shape, with two straight side stretches that are parallel and slightly spaced apart flatwise, and two curved ends connecting the straight side stretches. The sleeve may be deformed to form a cylindrical structure which can be axially slipped onto a circular frame.

However, the inventors herein have recognized potential disadvantages with the above approach. As one example, in the approach of Lechtenberg, if the frame onto which the sleeve is slipped on is not circular but has a square or rectangular cross section, the foam may be stretched at the corners of the square or rectangle upon deformation from a relaxed state to an expanded state. The stretching at the corners, may increase tension in the foam sleeve and cause degradation of the material. Further, stretching at the corners, may cause the foam sleeve to have uneven thickness around the periphery of the intake passage which may be not be beneficial in maintaining a seal. Also, due to the curved ends of the foam sleeve, it may not be possible to completely collapse the sleeve with the straight side stretches in face sharing contact.

The inventors herein have recognized that the issues described above may be addressed by a system for an engine, comprising: a collapsible foam sleeve fitted onto an engine passage, the collapsible sleeve including cuts on its surface. In this way, by incorporating cuts on the surface of the foam sleeve, structural integrity of the sleeve may be maintained in both the collapsed state and the expanded state.

In one example, a collapsible sleeve may be fabricated out of a block of foam material. The foam material may be cut using water jet or precision knives. Each sleeve may include two long sides connected by two short sides. Each of the two short sides may include a v-shaped cut. Each of the two long sides may include a pair of crests and troughs formed on the surface. In the collapsed state, the crests of a first, long side aligns with the troughs of a second, long side. The foam sleeves may be transported from the foam manufacturing unit to the engine assembly plant in collapsed form. Upon expansion of the collapsible sleeve, the sleeve may assume a hollow cubic shape with the two long sides and the two short sides forming the four walls. The hollow cubic sleeve may then be slipped onto the outer wall of an intake passage of the air induction system. The foam sleeve may circumferentially surround the outer wall of the intake passage.

In this way, by cutting a plurality of collapsible foam sleeved from a block of foam, wastage of foam material may be reduced and a larger number of sleeved may be fabricated from a single foam block, thereby reducing manufacturing costs. The technical effect of forming v-shaped cuts on the surface of a hollow, cubic sleeve is that it is possible to completely collapse the sleeve. By including crests and troughs on the surface, it is possible to align the sides of the sleeve in the collapsed state to facilitate packaging while transportation to the engine assembly plant. Upon expansion, the sleeve may form a hollow cuboid which may be snugly snapped on to an engine passage. Overall, due to the cubic shape of the sleeve, the structural integrity of the foam is maintained as it is fitted over a passage having a square or rectangular cross section.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2-4, and 7-8 are shown approximately to scale.

DETAILED DESCRIPTION

Figure 3A:
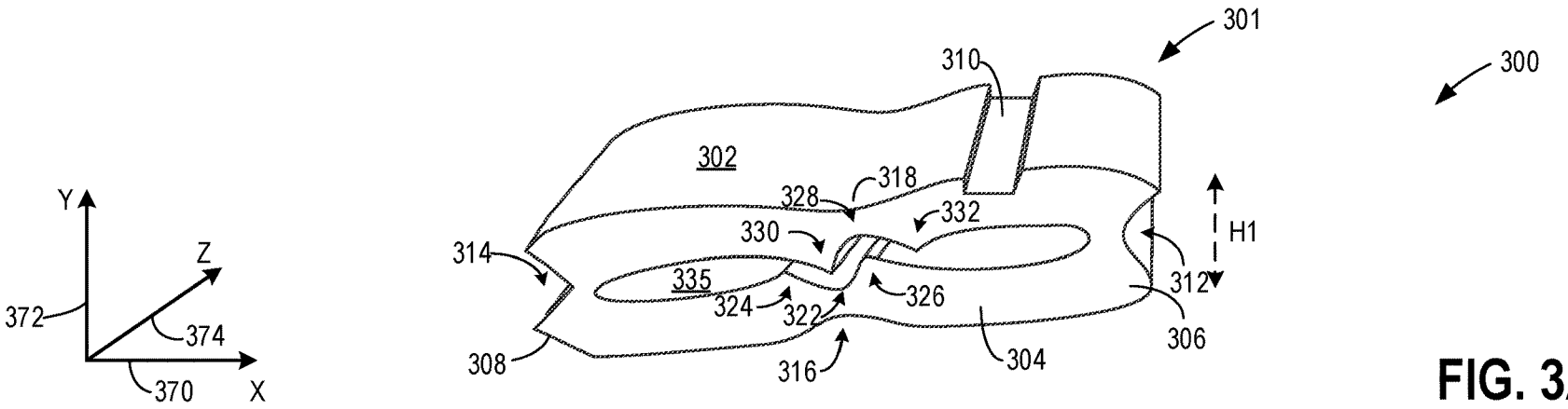
FIG. 3A shows a schematic depiction of the foam sleeve in a collapsed state.
Figure 3B:
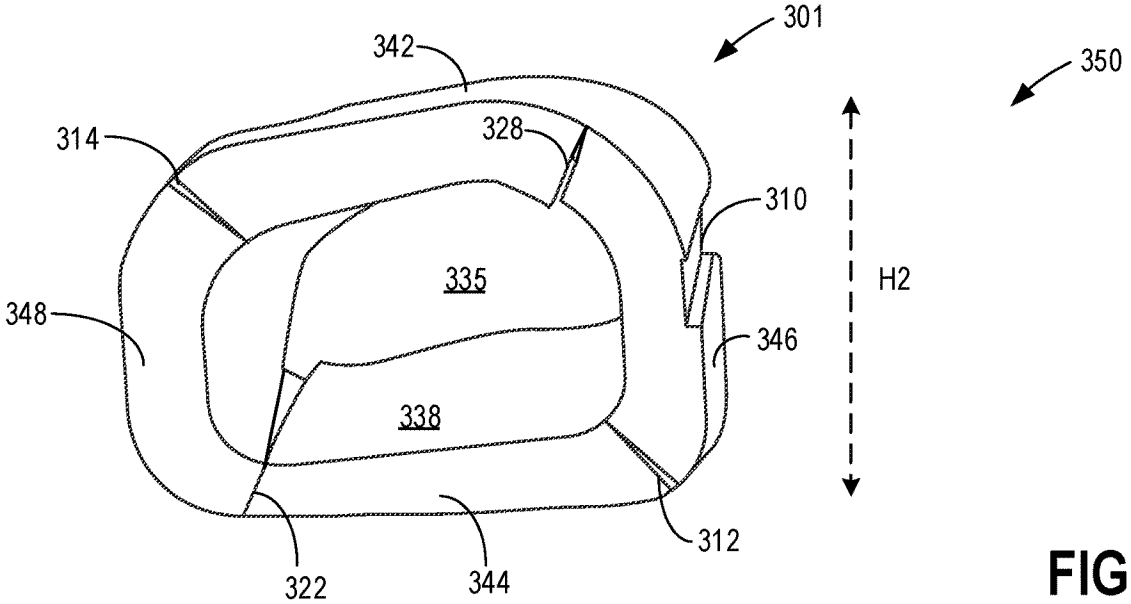
FIG. 3B shows a schematic depiction of the foam sleeve in an expanded state.
Figure 4:
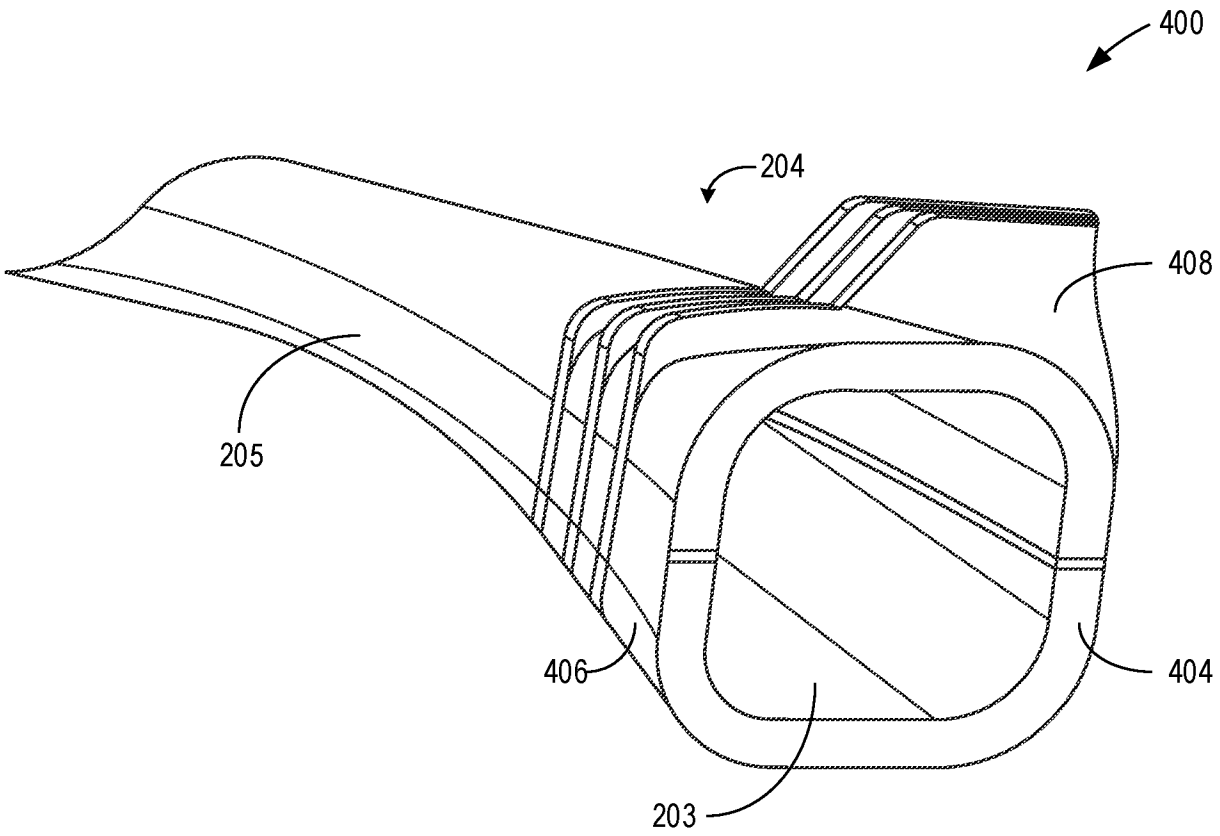
FIG. 4 shows a schematic of an air intake passage.
Figure 5:
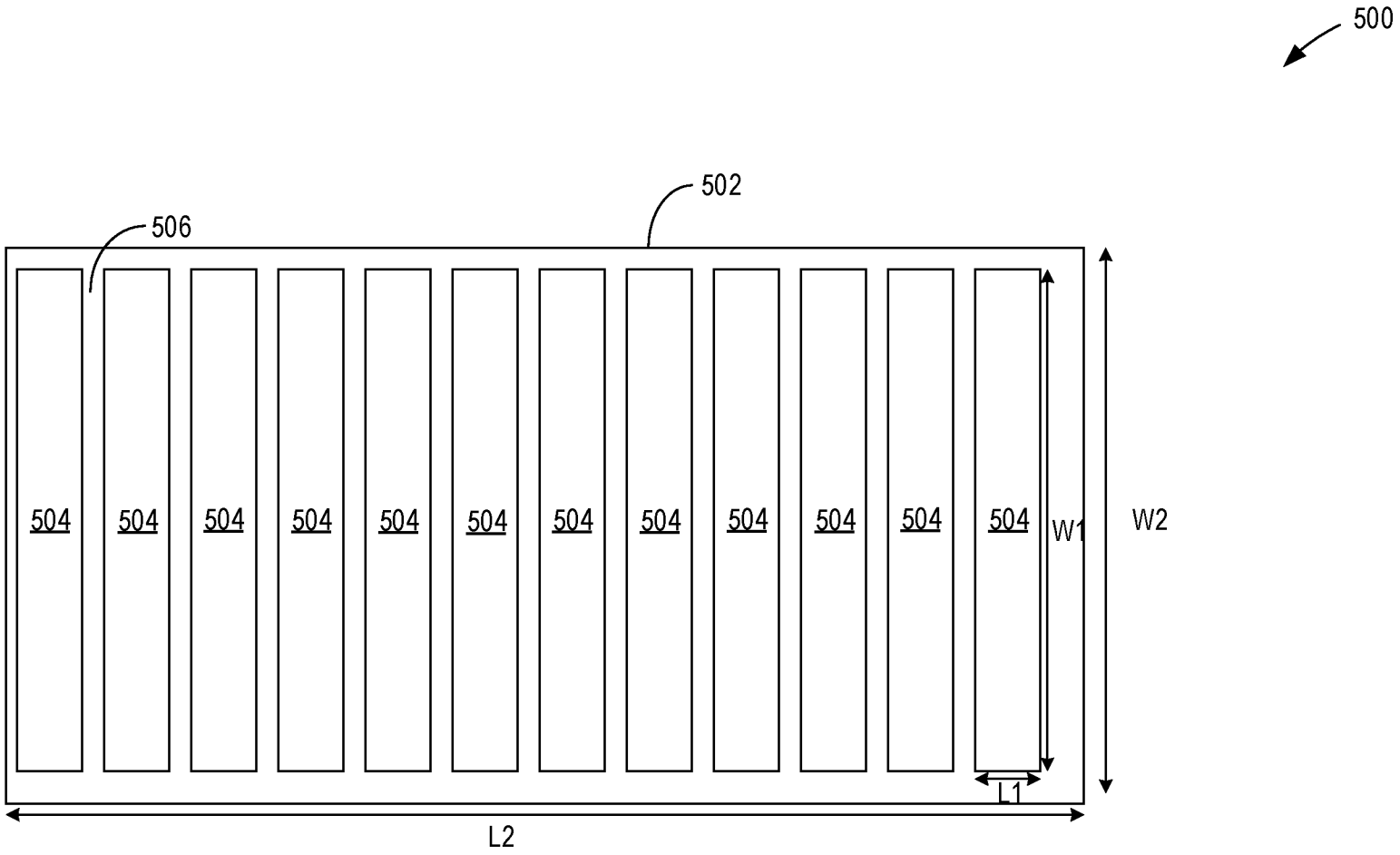
FIG. 5 shows a schematic of a foam block used for fabricating a plurality of foam sleeves.
Figure 7:
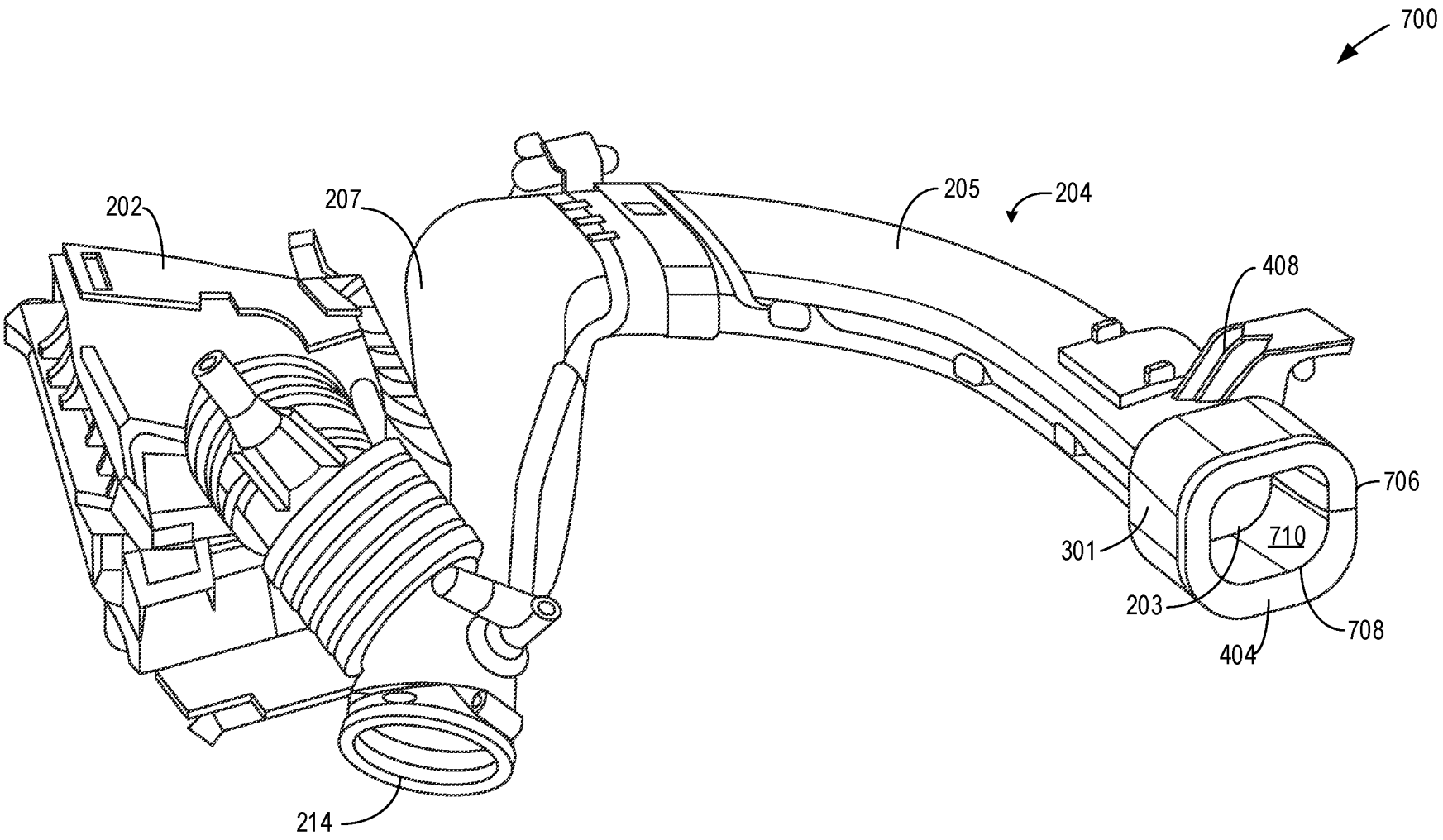
FIG. 7 shows a first schematic of an air intake passage including the foam sleeve.
Figure 8:
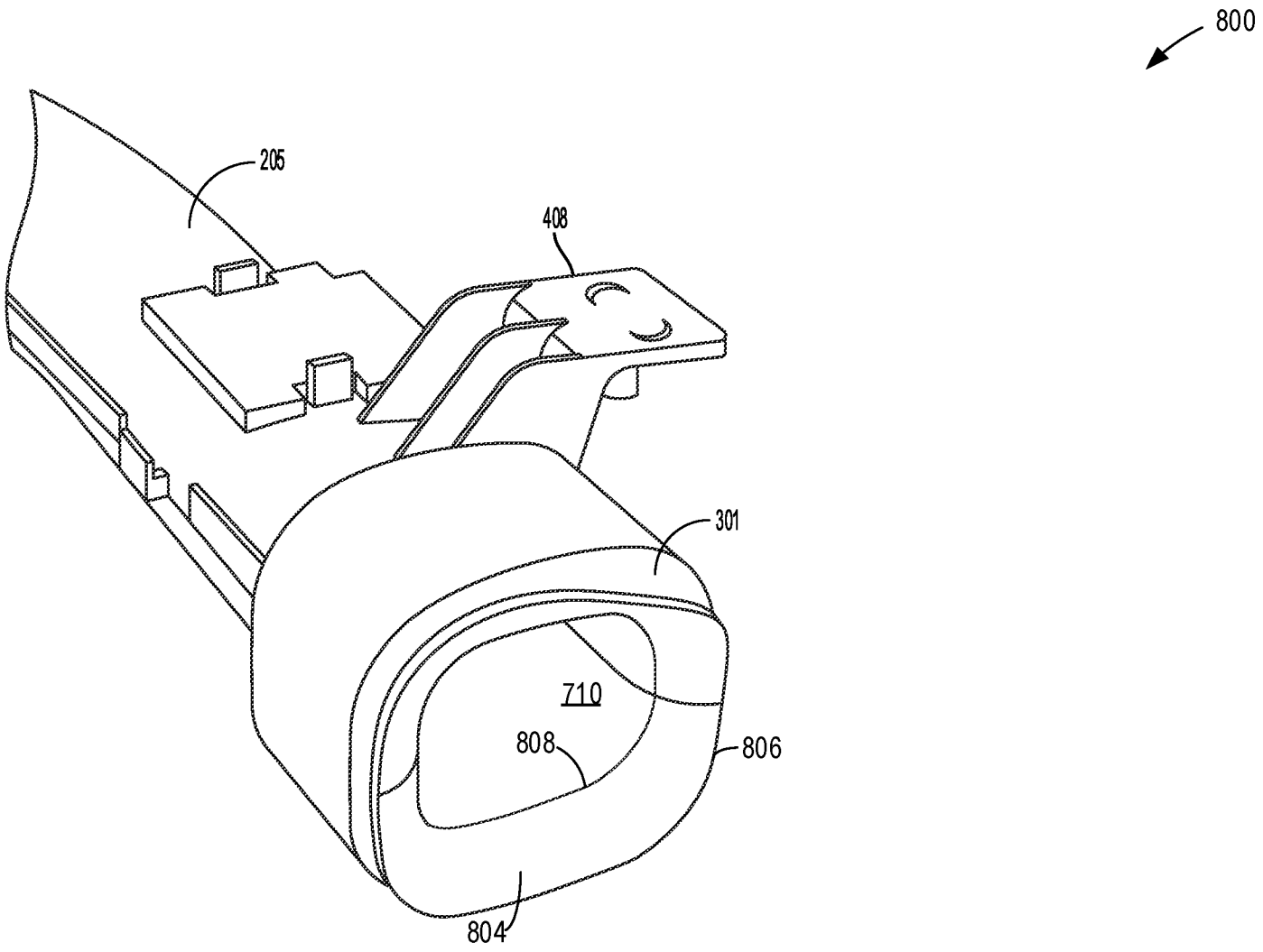
FIG. 8 shows a second schematic of an air intake passage including the foam sleeve.

The following description relates to systems and methods for a collapsible foam sleeve coupled to an air induction system passage of an engine system. The collapsible foam sleeve may be snapped on an intake passage of an air induction system, such as air induction system of FIG. 2 coupled within an engine system of FIG. 1. The intake air passage is shown in FIG. 4. The air intake passage fitted with the foam sleeve is shown in FIGS. 7-8. The collapsed state and the expanded state of the foam sleeve is schematically shown in FIGS. 3A-3B, respectively. A plurality of foam sleeves may be fabricated from a single foam block, as shown in FIG. 5. Manufacture of the foam sleeve and subsequent incorporation of the foam sleeve in the engine system is shown in the flow chart of FIG. 6.

Figure 1:
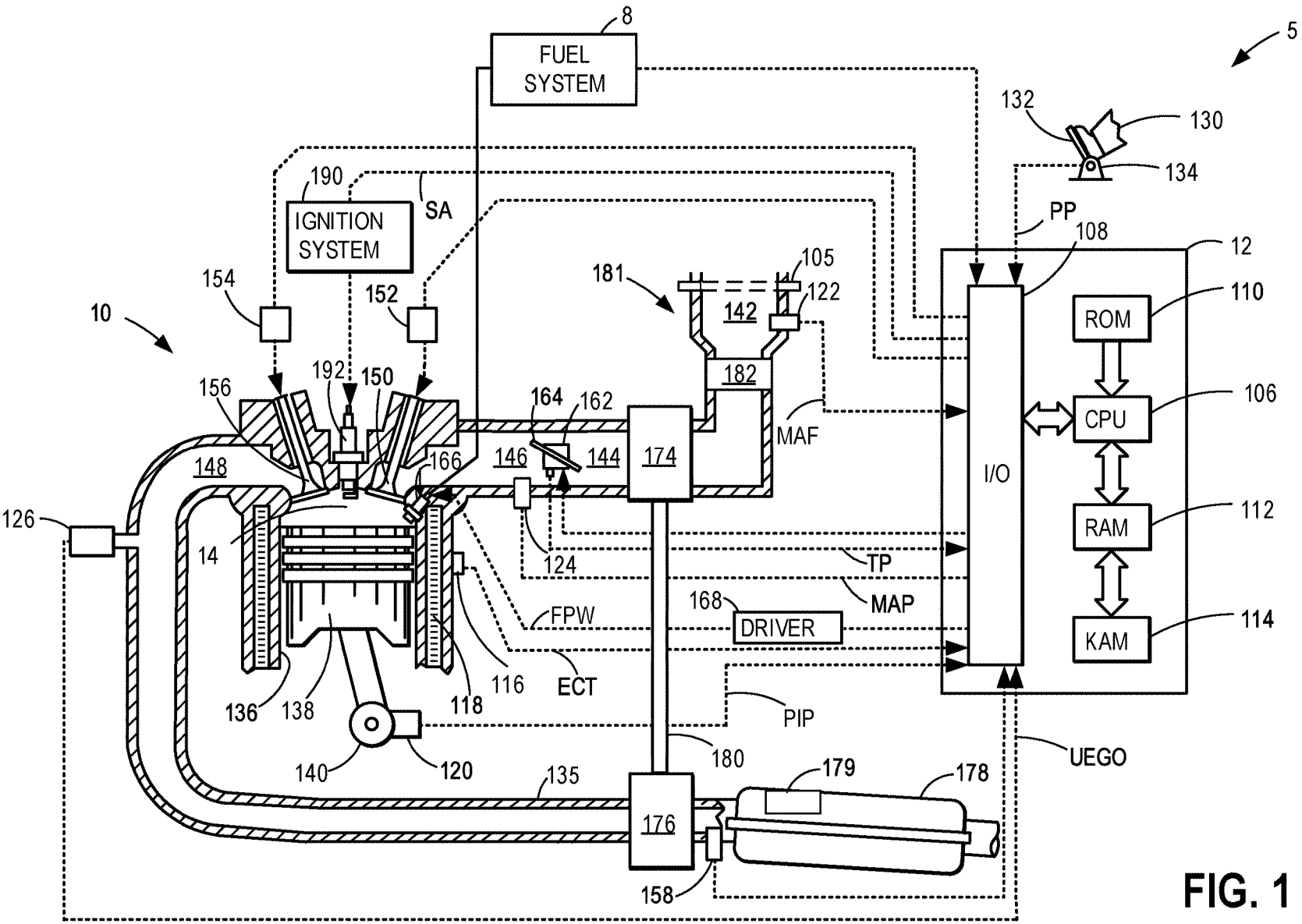
FIG. 1 shows a schematic depiction of a vehicle including an engine system.

FIG. 1 depicts an example of a cylinder 14 of an internal combustion engine 10, which may be included in a vehicle 5. Engine 10 may be controlled at least partially by a control system, including a controller 12, and by input from a vehicle operator 130 via an input device 132. In this example, input device 132 includes an accelerator pedal and a pedal position sensor 134 for generating a proportional pedal position signal PP. Cylinder (herein, also "combustion chamber") 14 of engine 10 may include combustion chamber walls 136 with a piston 138 positioned therein. Piston 138 may be coupled to a crankshaft 140 so that reciprocating motion of the piston is translated into rotational motion of the crankshaft. A starter motor (not shown) may be coupled to crankshaft 140 via a flywheel to enable a starting operation of engine 10.

Cylinder 14 of engine 10 can receive intake air via a series of intake passages 142 and 144 and an intake manifold 146. Intake manifold 146 can communicate with other cylinders of engine 10 in addition to cylinder 14. One or more of the intake passages may include one or more boosting devices, such as a turbocharger or a supercharger. For example, FIG. 1 shows engine 10 configured with a turbocharger, including a compressor 174 arranged between intake passages 142 and 144 and an exhaust turbine 176 arranged along an exhaust passage 135. Compressor 174 may be at least partially powered by exhaust turbine 176 via a shaft 180 when the boosting device is configured as a turbocharger. However, in other examples, such as when engine 10 is provided with a supercharger, compressor 174 may be powered by mechanical input from a motor or the engine and exhaust turbine 176 may be optionally omitted. In still other examples, engine 10 may be provided with an electric supercharger (e.g., an "eBooster"), and compressor 174 may be driven by an electric motor.

The engine air induction system 181 may include an intake air filter 182 comprising an air cleaner box may be housed in the air intake passage 142 to remove impurities from intake air reaching the compressor 174. A foam sleeve may circumferentially surround a perimeter of an outer wall of intake passage 142. An inner surface of the collapsible foam may be in face-sharing contact with an outer wall of the intake passage 142. The sleeve may be a continuous structure including four substantially equal sides with rounded corners enclosing an opening and relief cuts along each rounded corner. The relief cuts may include a first cut along a first corner with walls of the first cut pinched together, a second cut along a second corner with walls of the second cut pinched together, a third cut along a third corner with walls of the third cut pinched together, and a fourth cut along a fourth corner with walls of the fourth cut pinched together. The foam sleeve may be in a more flattened configuration with an elongated cross-section in a collapsed state and the foam sleeve may be a hollow cuboid with a substantially rectangular cross-section and rounded corners in an expanded state, a height of the foam sleeve in the collapsed state lower than a height of the foam sleeve in the expanded state. Embodiments of an example foam sleeve in collapsed and expanded form are elaborated in relation to FIGS. 3A-3B. In one example, a mass air flow sensor (MAFS) 122 or air intake temperature sensor (IAT) 122 may be included in the air filter system 182. By including the foam sleeve, sealing of the intake passage 142 and NVH concerns may be improved. Also, during higher ambient temperatures, the foam sleeve may reduce flow of heated ambient air into the engine air induction system.

A throttle 162 including a throttle plate 164 may be provided in the engine intake passages for varying the flow rate and/or pressure of intake air provided to the engine cylinders. For example, throttle 162 may be positioned downstream of compressor 174, as shown in FIG. 1, or may be alternatively provided upstream of compressor 174.

An exhaust manifold 148 can receive exhaust gases from other cylinders of engine 10 in addition to cylinder 14. An exhaust gas sensor 126 is shown coupled to exhaust manifold 148 upstream of an emission control device 178. Exhaust gas sensor 126 may be selected from among various suitable sensors for providing an indication of an exhaust gas air/fuel ratio (AFR), such as a linear oxygen sensor or UEGO (universal or wide-range exhaust gas oxygen), a two-state oxygen sensor or EGO, a HEGO (heated EGO), a NOx, a HC, or a CO sensor, for example. In the example of FIG. 1, exhaust gas sensor 126 is a UEGO. Emission control device 178 may be a three-way catalyst, a NOx trap, various other emission control devices, or combinations thereof. In the example of FIG. 1, emission control device 178 is an electrically heated catalyst (EHC). An electric heater (herein also referred to as a heating element) 179 may be coupled to the EHC 178 to electrically heat the catalyst during cold-start conditions. By actively heating the EHC 178, catalyst light-off may be expedited, thereby improving emissions quality during cold-start conditions.

An exhaust gas recirculation (EGR) delivery passage may be coupled to the exhaust passage upstream of turbine 176 to provide high pressure EGR (HP-EGR) to the engine intake manifold, downstream of compressor 174. An EGR valve may be coupled to the EGR passage at the junction of the EGR passage and the intake passage. EGR valve may be opened to admit a controlled amount of exhaust to the compressor outlet for desirable combustion and emissions control performance. EGR valve may be configured as a continuously variable valve or as an on/off valve. In further embodiments, the engine system may include a low pressure EGR (LP-EGR) flow path wherein exhaust gas is drawn from downstream of turbine 176 and recirculated to the engine intake manifold, upstream of compressor 174.

Each cylinder of engine 10 may include one or more intake valves and one or more exhaust valves. For example, cylinder 14 is shown including at least one intake valve 150 and at least one exhaust valve 156 located at an upper region of cylinder 14. In some examples, each cylinder of engine 10, including cylinder 14, may include at least two intake valves and at least two exhaust valves located at an upper region of the cylinder. Intake valve 150 may be controlled by controller 12 via an actuator 152. Similarly, exhaust valve 156 may be controlled by controller 12 via an actuator 154. The positions of intake valve 150 and exhaust valve 156 may be determined by respective valve position sensors (not shown).

During some conditions, controller 12 may vary the signals provided to actuators 152 and 154 to control the opening and closing of the respective intake and exhaust valves. The valve actuators may be of an electric valve actuation type, a cam actuation type, or a combination thereof. The intake and exhaust valve timing may be controlled concurrently, or any of a possibility of variable intake cam timing, variable exhaust cam timing, dual independent variable cam timing, or fixed cam timing may be used. Each cam actuation system may include one or more cams and may utilize one or more of cam profile switching (CPS), variable cam timing (VCT), variable valve timing (VVT), and/or variable valve lift (VVL) systems that may be operated by controller 12 to vary valve operation. For example, cylinder 14 may alternatively include an intake valve controlled via electric valve actuation and an exhaust valve controlled via cam actuation, including CPS and/or VCT. In other examples, the intake and exhaust valves may be controlled by a common valve actuator (or actuation system) or a variable valve timing actuator (or actuation system).

In some examples, each cylinder of engine 10 may be configured with one or more fuel injectors for providing fuel thereto. As a non-limiting example, cylinder 14 is shown including a fuel injector 166. Fuel injector 166 may be configured to deliver fuel received from a fuel system 8. Fuel system 8 may include one or more fuel tanks, fuel pumps, and fuel rails. Fuel injector 166 is shown coupled directly to cylinder 14 for injecting fuel directly therein in proportion to a pulse width of a signal FPW received from controller 12 via an electronic driver 168. In this manner, fuel injector 166 provides what is known as direct injection (hereafter also referred to as "DI") of fuel into cylinder 14. While FIG. 1 shows fuel injector 166 positioned to one side of cylinder 14, fuel injector 166 may alternatively be located overhead of the piston, such as near the position of spark plug 192. Fuel may be delivered to fuel injector 166 from a fuel tank of fuel system 8 via a high pressure fuel pump and a fuel rail. Further, the fuel tank may have a pressure transducer providing a signal to controller 12.

In an alternate example, fuel injector 166 may be arranged in an intake passage rather than coupled directly to cylinder 14 in a configuration that provides what is known as port injection of fuel (hereafter also referred to as "PFI") into an intake port upstream of cylinder 14. In yet other examples, cylinder 14 may include multiple injectors, which may be configured as direct fuel injectors, port fuel injectors, or a combination thereof. As such, it should be appreciated that the fuel systems described herein should not be limited by the particular fuel injector configurations described herein by way of example.

Each cylinder of engine 10 may include a spark plug 192 for initiating combustion. An ignition system 190 can provide an ignition spark to combustion chamber 14 via spark plug 192 in response to a spark advance signal SA from controller 12, under select operating modes. A timing of signal SA may be adjusted based on engine operating conditions and driver torque demand. For example, spark may be provided at maximum brake torque (MBT) timing to maximize engine power and efficiency.

Controller 12 is shown in FIG. 1 as a microcomputer, including a microprocessor unit 106, input/output ports 108, an electronic storage medium for executable programs (e.g., executable instructions) and calibration values shown as non-transitory read-only memory chip 110 in this particular example, random access memory 112, keep alive memory 114, and a data bus. Controller 12 may receive various signals from sensors coupled to engine 10, including signals previously discussed and additionally including a measurement of inducted mass air flow (MAF) from a mass air flow sensor 122; an engine coolant temperature (ECT) from a temperature sensor 116 coupled to a cooling sleeve 118; an exhaust gas temperature from a temperature sensor 158 coupled to exhaust passage 135; a profile ignition pickup signal (PIP) from a Hall effect sensor 120 (or other type) coupled to crankshaft 140; throttle position (TP) from a throttle position sensor; signal UEGO from exhaust gas sensor 126, which may be used by controller 12 to determine the AFR of the exhaust gas; and an absolute manifold pressure signal (MAP) from a MAP sensor 124. An engine speed signal, RPM, may be generated by controller 12 from signal PIP. The manifold pressure signal MAP from MAP sensor 124 may be used to provide an indication of vacuum or pressure in the intake manifold. Controller 12 may infer an engine temperature based on the engine coolant temperature and infer a temperature of emission control device 178 based on the signal received from temperature sensor 158.

Controller 12 receives signals from the various sensors of FIG. 1 and employs the various actuators of FIG. 1 to adjust engine operation based on the received signals and instructions stored on a memory of the controller. For example, the controller may operate a single pump coupled to two engine valves based on valve timing and a position of the valve to open or close the respective valve.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

Figure 2:
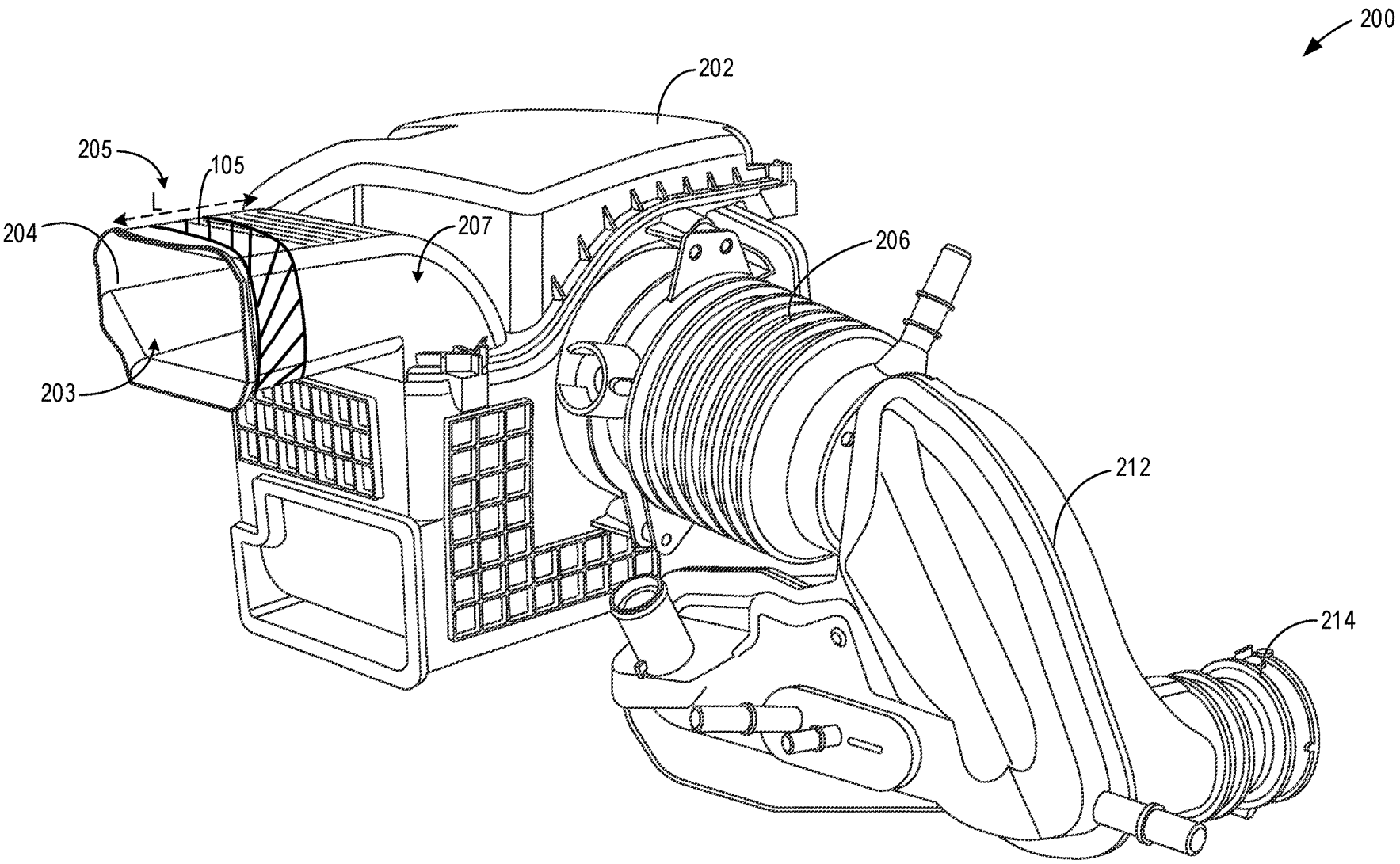
FIG. 2 shows an air induction system including a foam sleeve.

FIG. 2 shows an example embodiment 200 of an air induction system including a foam sleeve. The air induction system may include a cuboid shaped air cleaner box 202. Ambient air may enter the air cleaner box 202 via an intake passage 204 fluidically coupling the engine to the atmosphere. The outlet of the air cleaner box 202 may include a duct (also referred herein as air conduit or cylindrical passage) 206 followed by a passage 212 and a clean air tube 214 leading to the engine intake manifold. A throttle or turbocharger inlet may be positioned in the engine intake manifold to regulate the amount of air entering the clean air tube (CAT) 214 of one or more engine cylinders. Air from the air cleaner box 202 may be supplied to clean air tube 214 via each of the duct 206 and the passage 210.

The intake passage 204 may include a planer section 205 and a curved section 207, the curved section physically coupled to the air cleaner box 202. The planer section 205 of the intake passage may have a length L and a substantially rectangular cross-section with an opening 203. The rectangular cross-section of the opening may have rounded corners. Ambient air may enter the engine air induction system via the opening 203. The hollow cuboid foam sleeve 105 may be slid on to the outer wall of the intake passage (planer section 205) proximal to the opening and the sleeve 105 may extend along a portion of a length L of the planer section 205 from the opening 203 towards the curved section 207. The foam sleeve may extend 10-25% of the length L and cover a portion of the planer section of the intake passage 204. In one example, the sleeve 105 may cover the entire planer section 205 of the intake passage 204. The inner dimensions (distance between parallel sides) of the sleeve 105 may correspond to the dimensions (sides of the rectangle) of the outer wall of the intake passage causing the sleeve to snugly fit onto the intake passage wall. The sleeve 105 may circumferentially surround the perimeter of the outer wall of the intake passage 204.

FIG. 4 shows a perspective view 400 of the air intake passage 204 of FIG. 2. The planer section 205 of the air intake passage 204 may end in a rectangular opening 203. The boundary of the opening may include a frame 404 projecting laterally outward from the opening. A bracket 408 may be coupled to the outer wall of the passage 204 for attaching the passage 204 to other engine components. The bracket 408 may include a ribbed portion circumferentially surrounding a perimeter of the outer wall and a protruding portion projecting outward from the passage 204. The region 406 of the outer wall of the passage 204 may form a housing for the foam sleeve (not shown in FIG. 4). In the expanded form, the sleeve may be slid over the frame 404 and positioned in the region 406 between the frame 404 and the bracket 408. In one example, a groove may be formed in the region 406 for housing the frame.

FIG. 7 shows a perspective view 700 of the air intake passage 204 of FIG. 4 with a foam sleeve installed. Components previously introduced are numbered similarly and not reintroduced. The intake air passage 204 may lead to an air cleaner box 202 and a clean air tube 214 routing ambient air to the engine cylinders. The intake passage 204 may include a planer section 205 and a curved section 207, the curved section physically coupled to the air cleaner box 202 and the planer section ending in a rectangular opening 203. The boundary of the opening 203 may include a frame 404 projecting laterally outward from the opening. In this example, the frame 404 may be rigid with sharp inner edge 708 and outer edge 706. The inner edge 708 and the outer edge 706 may be coplanar and the inner edge 708 may form a right angle with the inner wall 710 of the frame 404. A bracket 408 may be coupled to the outer wall of the passage 204 for attaching the passage 204 to other engine components. The bracket 408 may include a ribbed portion (not shown) circumferentially surrounding a perimeter of the outer wall and a protruding portion projecting outward from the passage 204.

The foam sleeve 301 may be slid onto the air intake passage 204 and placed between the frame 404 and the bracket 408. The inner surface of the sleeve 301 may remain in face sharing contact with the outer wall of the intake passage. Due to the presence of the frame 404 on one side and the bracket 408 on another side, the sleeve may not glide along the outer wall of the intake passage 204. The sleeve may form effective sealing of the intake passage and improve engine noise vibration harshness (NVH) concerns.

FIG. 8 shows a perspective view 800 of the planer section 205 of the air intake passage 204 of FIG. 4 with a foam sleeve installed. In this example, a boundary of a rectangular opening of the air intake passage may include a frame 804 projecting laterally outward from the opening. Unlike the frame 404 (previously discussed with reference to FIG. 7), the frame 804 may be flexible with bendable ends. The frame may be curved and the surface of the frame may gently slope inward from the outer edge 806 to the inner edge 808. Due to the curvature, the angle between the inner edge 808 and the inner wall 710 of the frame may be higher than 90°. A bracket 408 may be coupled to the outer wall of the passage 204 for attaching the passage 204 to other engine components. The foam sleeve 301 may be slid onto the air intake passage 204 and placed between the frame 804 and the bracket 408. The inner surface of the sleeve may remain in face sharing contact with the outer wall of the intake passage. The flexibility of the frame 804 may increase the ease of sliding the foam sleeve 301 past the frame 804 and onto the air intake passage 204.

FIG. 3A shows a schematic depiction 300 of a foam sleeve 301 in a collapsed state. Foam sleeve 301 may be the foam sleeve 105 in FIG. 2 and the sleeve may be slid on to an outer wall of an air intake passage (such as the intake passage 142 in FIG. 1).

The sleeve 301 may include two long substantially parallel sides, a first long side 302 and a second long side 304. The widths (along z-axis 374), the lengths (along x-axis 370), and the thicknesses (along y-axis 372) of each of the first long side 302 and the second long side 304 may be equal with the width of each side being smaller than its length. Each of the first long side 302 and the second long side 304 may be curved (wavy) along its length with depressions 318 and 316, respectively, formed at the center of each long side. A basin 310 may be formed across the width (along z-axis 374) of the outer wall of the first long side. The basin 310 may have parallel sides and a flat bottom side. The Basin 310 may be a PokaYoke arrangement and provide a visual reference to a manufacture team to assemble the foam in an intended position with reference to other engine components.

The first long side 302 may include a first pair of crests (peaks) 330 and 332 with a first trough (valley) 328 between the crests along an inner wall. The position of the trough 328 may correspond to the depression 318 but the trough 328 may not extend through the thickness of the first long side 302. The crests (peaks) may point to an opening 335 of the sleeve and the trough 328 may point to the outer wall of the first long side 302. Similarly, the second long side 304 may include a second pair of crests (peaks) 324 and 326 with a second trough (valley) 322 between the crests along an inner wall. The position of the trough 322 may correspond to the depression 316 but the trough 322 may not extend through the thickness of the second long side 304. The crests (peaks) 324 and 326 may point to an opening 335 of the sleeve and the trough 322 may point to the outer wall of the second long side 304. In the collapsed state, the crest 330 of the first long side 302 may align with the trough 322 of the second long side, and the crest 326 of the second long side 304 may align with the trough 328 of the first long side. In the collapsed state, the inner wall of the first long side 302 may be proximal to the inner wall of the second long side 304. In one example, the two long sides 302, 304 may not be in contact. In another example, at least portions of the two long sides 302, 304 may be in face sharing contact.

The first long side 302 and the second long side 304 may be connected by two short sides on each end. A first short side 308 may be substantially parallel to the second short side 306. In one example, the widths, the lengths, and the thicknesses of the first short side 308 may be equal to the corresponding widths, the lengths, and the thicknesses of the second short side 306. The first long side 302, the second long side 304, the first short side 308, and the second long side 306 form a seamlessly continuous structure (sleeve) enclosing the opening 335. Being a unitary continuous structure, the foam sleeve 301 may not include any seams, joints, welds, adhesive points, etc. By eliminating any joints, structural integrity of the foam sleeve 301 may be improved relative to structures that are formed of two or more components joined via welding and/or adhesive. Also, by forming a single structure, manufacturing process of the foam sleeve may be simplified without having to join multiple pieces. In the collapsed state, the opening 335 may be elongated along the x-axis 370. The first short side 308 may include a first v-shaped cut 314 across its width. In one example, the cut 314 may extend from a junction of the first short side 308 and the first long side 302 to another junction of the first short side 308 and the second long side 304. The first v-shaped cut 314 may not extend throughout the thickness of the short side 308. In one example, the first v-shaped cut 314 may extend 80% into the thickness of the short side 308. The apex of the V-shaped cut 314 may extend towards the opening 335. Similarly, the second short side 306 may include a second v-shaped cut 312 across its width. In one example, the cut 312 may extend from a junction of the second short side 306 and the first long side 302 to another junction of the second short side 306 and the second long side 304. The second v-shaped cut 312 may not extend throughout the thickness of the short side 306. In one example, the second v-shaped cut 312 may extend 80% into the thickness of the short side 306. The extension of the v-shaped cuts on each of the short sides provides the flexibility to flatten the foam sleeve while maintaining structural integrity. The apex of the V-shaped cut 312 may extend towards the opening 335. The apex of the first cut 314 may face the apex of the second cut 312 on both sides of the opening 335. In the relaxed, collapsed state, the foam sleeve forms a continuous, elongated race track shape enclosing an elongated opening 335. The V-shaped cuts 314, 312 allow the foam sleeve to the flattened without causing structural damage to the foam material. Due to the flattened, elongated nature of the sleeve in the collapsed form, multiple sleeves may be stacked, thereby requiring less storage space during transportation. The V-shaped cuts and the crests and troughs on the surface of the foam sleeve may also be termed as relief cuts since stress at the corners of the foam sleeve may be reduced due to the presence of the cuts.

FIG. 3B shows a schematic 350 of the foam sleeve 301 in an expanded state. The foam sleeve 301, as seen in FIG. 3A, may be expended (by pulling) along the parallel short sides (along the y-axis 372) to form a hollow cuboid sleeve with a substantially rectangular cross-section having rounded corners. In one example, in the substantially rectangular cross-section, the angle between two adjacent sides may be a right angle. In another example, in the substantially rectangular cross-section, the four corner angles may not be equal and the angle between any two adjacent sides may be between 80° and 100° causing the rectangular cross-section to be contorted. The hollow cuboid sleeve 301 may have an oblong cross-section with rounded corners.

The height/thickness (along y-axis 372) of the foam sleeve in the expanded state (H2) may be higher (linger) than the height/thickness (H1) of the foam sleeve in the collapsed state. The sleeve may include a first side 342, a second side 344, a third side 348, and a fourth side 346. During the expansion of the foam sleeve from the collapsed state, each of the first long side 302, the second long side 304, the first short side 308, and the second long side 306 may be contorted to form each of the first side 342, the second side 344, the third side 348, and the fourth side 346. In one example, the first side 342 may correspond to the region of the collapsed sleeve between the first v-shaped cut 314 and the first trough 328, the second side 344 may correspond to the region of the collapsed sleeve between the second v-shaped cut 312 and the second trough 322, the third side 348 may correspond to the region of the collapsed sleeve between the first v-shaped cut 314 and the second trough 322, and the fourth side 346 may correspond to the region of the collapsed sleeve between the second v-shaped cut 312 and the first trough 328.

Upon expanding the foam sleeve, the two v-shaped cuts 314 and 312 may be pinched with the walls of the V-shape coming closer and bridging the gap between the walls. In one example, due to the pinching of the cuts, the corresponding walls of each V-shaped cut may be in contact completely bridging the gap between the walls. Also, the first pair of crests 330 and 332 may be pinched around the first trough 328, bridging the gap between the crests 330 and 332, and the second pair of crests 324 and 326 may be pinched around the second trough 322, bridging the gap between the crests 324 and 326. In the expanded state, the first V-shaped cut 314 is positioned at a first rounded corner, the second V-shaped cut 312 is positioned at a second rounded corner, the first pair of crests are positioned at a third rounded corner, and the second pair of crests are positioned at a fourth corner, the first corner being diagonally opposite to the second corner, and the third corner being diagonally opposite to the fourth corner. In one example, the first side 342 and the second side 344 may be parallel and of equal dimensions (length, width, and thickness) while the third side 348 and the fourth side 346 may be parallel and of equal dimensions (length, width, and thickness). In one example, the cross-section of the sleeve may be a square with each of the first side 342, the second side 344, the third side 348, and the fourth side 346 of equal dimension.

Upon expansion, the foam sleeve assumes a shape of a hollow cuboid. In one example, the sleeve may have a substantially rectangular cross-section with rounded walls and an opening 335. In another example, the sleeve may have a square cross-section with rounded walls. In a further example, the sleeve may have a circular cross section. By including the cuts on the surface of the sleeve and making the corners of the cuboid rounded, stress concentration on the corners of the sleeve may be reduced, thereby improving its structural integrity. The sleeve may be axially slipped over an engine passage such as an intake air passage with the inner surface 338 of the sleeve 301 in face sharing contact with the outer wall of the engine passage. The dimensions of the inner surface 338 of the sleeve may correspond to the dimensions of the outer wall of the engine passage ensuring a snug fitting of the sleeve on to the engine passage.

FIG. 5 shows a schematic 500 of a foam block 502 used for fabricating a plurality of foam sleeves 504. The foam block may be a polyurethane foam block. Each foam sleeve 504 (simplified here as a rectangular block) may be the foam sleeve 301 in FIGS. 3A-3B.

The width (W2) of the block 502 may be greater than or equal to the dimension of the longer side (W1) of the biggest foam sleeve to be fabricated out of the block. The length (L2) of the block 502 may be based on the dimension of the shorter side (L1) of the foam sleeve and a number of foam sleeves to be fabricated out of the block 502. In one example, each sleeve fabricated out of the block 502 may be identical in size and shape. In another example, there may be difference in size between sleeves fabricated from the block 504.

The sleeves 504 may be cut from the block 502 by using one or more tools such as water jet, knife, dies. Each sleeve 504 is cut out of the foam block 502 as a single piece in the collapsed state. The relief cuts (cuts, crest, and trough) on the surface of each sleeve as discussed with reference to FIGS. 3A-B may also be made using the one or more tools during the cutting process. In one example, all the sleeves 504 may be simultaneously cut from the block 502. In another example, the sleeves 504 may be sequentially cut from the block 502.

In one example, there may be a gap (foam material remaining) 506 between two immediately adjacent sleeves 504 as they are being cut out of the block 502. However to save material, a longer side surface of a sleeve may correspond to another longer side surface of an immediately adjacent sleeve with no gap (foam material remaining) between two immediately adjacent sleeves 504. In this way, by cutting multiple sleeves in a collapsed state from a block of foam, foam material may be saved and process efficiency may be improved.

Figure 6:
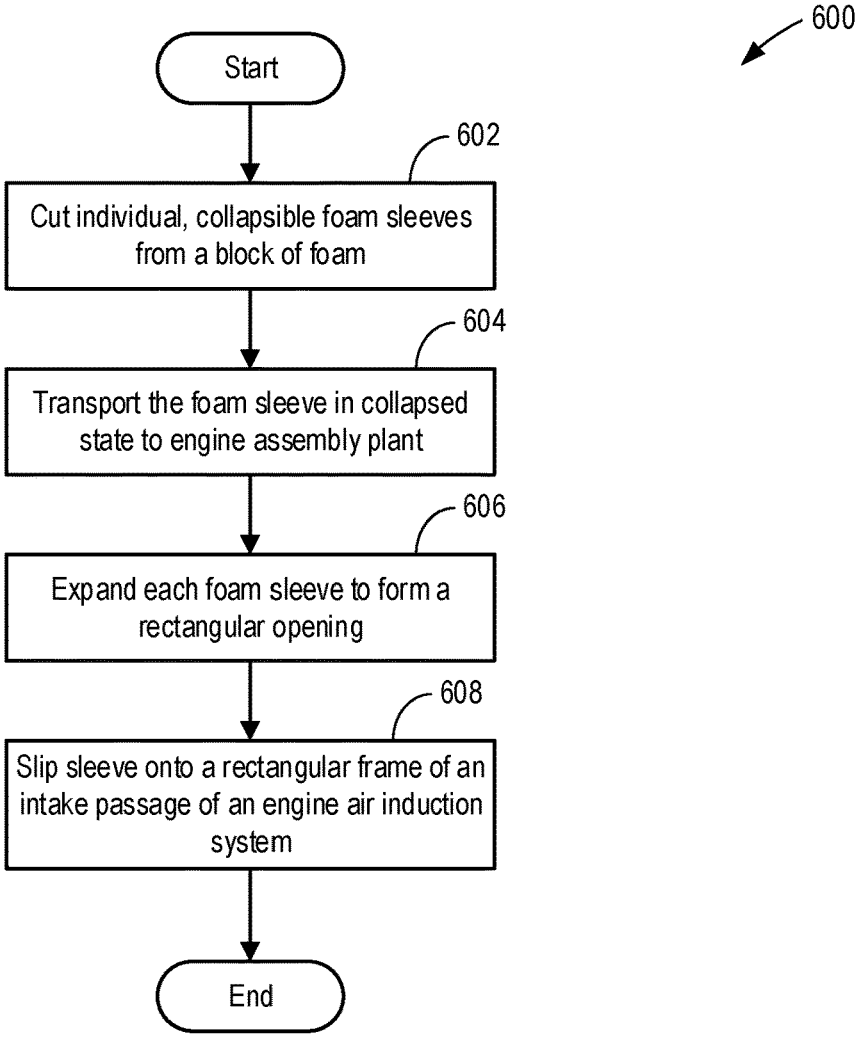
FIG. 6 shows a flow chart illustrating a method for manufacture of a foam sleeve and assembly of the foam sleeve to an engine system.

FIG. 6 shows an example method for manufacture of a foam sleeve (such as foam sleeve 301 in FIG. 3A-B) and assembly of the foam sleeve to an engine system (such as engine 10 in FIG. 1) coupled within a vehicle (such as vehicle 5 in FIG. 1). The foam sleeves may be manufactured at a foam processing facility different from an engine assembly plant. The foam processing facility may be located at a different city (and country) from the engine assembly plant.

At 602, at the foam processing facility, individual foam sleeves may be cut (formed) from a block of foam (such as foam block 502 in FIG. 5) using one or more tools including water jet cutter, knife, dies, etc. A plurality of foam sleeves may be cut from a single block of foam. Each sleeve may cut out of the foam block as a single piece in the collapsed state. A plurality of relief cuts (cuts, crest, and trough) on the surface of each sleeve may also be carved out using the one or more tools during the cutting process. All the sleeves may be simultaneously cut from the block or the sleeves may be sequentially cut from the block. The relief cuts may include each of a first cut across a width of a first side of the foam sleeve, a second cut across a width of a second side of the foam sleeve, a first pair of crests and a first trough along a width of a third side, and a second pair of crests and a second trough along a width of a fourth side. In the collapsed state, each of the first cut, the second cut, the first trough, and the second trough may be in an open condition. The open condition includes respective walls of each of the first cut, the second cut, the first trough, and the second trough to be separated.

At 604, the foam sleeves may be transported from the foam processing facility to the engine assembly plant in a collapsed state. In the collapsed state, a plurality of foams sleeves may be stacked and packaged with a smaller volume. Therefore, transporting the foam sleeves in a collapsed and stacked formation may save space and transportation costs. The foam sleeves may be transported via land (such as via trucks), sea (such as via ships), and/or air (such as via airplanes) to the engine assembly plant.

At 606, at the engine assembly plant, each foam sleeve is expanded to form a hollow cubic shape. The foam sleeve may be mechanically (by use of a machine) expanded from the collapsed state by pulling along a width of the sleeve. During expansion of the foam sleeve, the regions of the foam that include the relief cuts may be bent. In other words, the foam sleeve may be repositioned to he expanded state from the collapsed state by pulling the third side of the sleeve away from the fourth side to bend each of the first side, the second side, the third side, and the fourth side of the sleeve. In the expanded state, each of the first cut, the second cut, the first trough, and the second trough may be in a closed condition. The closed condition includes the respective walls of each of the first cut, the second cut, the first trough, and the second trough to be pinched together. In the expanded state, the relief cuts may include a first cut along the inner perimeter of a first corner with walls of the first cut pinched together, a second cut along the inner perimeter of a second corner with walls of the second cut pinched together, a third cut along the inner perimeter of a third corner with walls of the third cut pinched together, and a fourth cut along the inner perimeter of a fourth corner with walls of the fourth cut pinched together.

At 608, the sleeve may be slipped on to a rectangular frame of an intake passage of an engine air induction system. The inner dimensions (distance between parallel sides) of the sleeve may correspond to the dimensions (sides of the rectangle) of an outer wall of the intake passage causing the sleeve to snugly fit onto the intake passage wall. The sleeve may be in face sharing contact with the intake passage wall and the sleeve may circumferentially surround the perimeter of the outer wall of the intake passage. In alternate embodiments, one or more groves may be made on the surface of the intake passage outer wall to accommodate the sleeve and reduce the possibility of the sleeve slipping from its position around the intake passage.

In this way, the foam sleeve may be formed with multiple relief cuts on an outer perimeter, the foam sleeve may be transported in a collapsed state to an engine assembly plant, the foam sleeve may be repositioned to form a hollow cuboid by bending regions of the foam that include the relief cuts, the foam sleeve may be slipped in the expanded state onto a rectangular frame of an engine passage.

By designing collapsible sleeves with cuts on the surface, it is possible to fabricate a plurality of sleeves from a single foam block, thereby saving material wastegate and reducing manufacturing costs. By transporting the foam sleeves in the collapsed form, a larger number of sleeves may be stacked and transported, thereby reducing transportation costs. By including the cuts on the surface, it is possible to collapse a hollow cuboid with corners without deforming the shape of the sleeve. Overall, the design and manufacture of the foam sleeve is cost efficient and produces less waste material.

An example system for an engine comprises: a collapsible foam sleeve fitted onto an engine passage, the collapsible sleeve including cuts on its surface. In any preceding example, additionally or optionally, the foam sleeve is a continuous unitary structure including a first pair of sides and a second pair of sides, the second pair of sides connecting the first pair of sides. In any or all of the preceding examples, additionally or optionally, the foam sleeve is in a more flattened configuration with an elongated cross-section in a collapsed state and wherein the foam sleeve is a hollow cuboid with a substantially rectangular cross-section and rounded corners in an expanded state, a height of the foam sleeve in the collapsed state shorter than a height of the foam sleeve in the expanded state. In any or all of the preceding examples, additionally or optionally, in the collapsed state, the first set of sides include a first long side and a second long side, and the second set of sides include a first short side and a second short side. In any or all of the preceding examples, additionally or optionally, the first long side includes a first pair of crests and a first trough along a width of the first long side and the second long side includes a second pair of crests and a second trough along a width of the second long side. In any or all of the preceding examples, additionally or optionally, one crest of the first pair of crests align with the second trough, and wherein one crest of the second pair of crests align with the first through. In any or all of the preceding examples, additionally or optionally, the cuts include a first V-shaped cut across a width of the first short side and a second V-shaped cut across a width of the second short side, each of the first V-shaped cut and the second V-shaped cut not extending throughout the thickness of the first short side and the second short side, respectively. In any or all of the preceding examples, additionally or optionally, in the expanded state, walls of the first V-shaped cut are pinched together, walls of the second V-shaped cut are pinched together, the first pair of crests are pinched together, and the second pair of crests are pinched together. In any or all of the preceding examples, additionally or optionally, in the expanded state, the first V-shaped cut is positioned at a first rounded corner, the second V-shaped cut is positioned at a second rounded corner, the first pair of crests are positioned at a third rounded corner, and the second pair of crests are positioned at a fourth corner, the first corner being diagonally opposite to the second corner, and the third corner being diagonally opposite to the fourth corner. In any or all of the preceding examples, additionally or optionally, the engine passage is an intake air passage with a cross-section same as that of the sleeve in the expanded state, the sleeve circumferentially surrounding the intake air passage.

Another example method, comprises: forming the foam sleeve with multiple relief cuts on an outer perimeter, transporting the foam sleeve in a collapsed state to an engine assembly plant; repositioning the foam sleeve to form a hollow cuboid by bending regions of the foam that include the relief cuts, slipping the foam sleeve in the expanded state onto a rectangular frame of an engine passage. In any preceding example, additionally or optionally, the relief cuts include each of a first cut across a width of a first side of the foam sleeve, a second cut across a width of a second side of the foam sleeve, a first pair of crests and a first trough along a width of a third side, and a second pair of crests and a second trough along a width of a fourth side. In any or all of the preceding examples, additionally or optionally, in the collapsed state, each of the first cut, the second cut, the first trough, and the second trough are in an open condition, and wherein in the expanded state, each of the first cut, the second cut, the first trough, and the second trough are in a closed condition. In any or all of the preceding examples, additionally or optionally, open condition includes respective walls of each of the first cut, the second cut, the first trough, and the second trough to be separated, and wherein the closed condition includes the respective walls of each of the first cut, the second cut, the first trough, and the second trough to be pinched together. In any or all of the preceding examples, additionally or optionally, the foam sleeve is repositioned from the collapsed state by pulling along the third side of the sleeve away from the fourth side to bend each of the first side, the second side, the third side, and the fourth side. In any or all of the preceding examples, additionally or optionally, the foam sleeve is formed from the block of foam using a jet water jet cutter, a knife, and/or dies. In any or all of the preceding examples, the method further comprising, additionally or optionally, forming a plurality of foam sleeves from the block of foam and stacking the plurality of foam sleeves during transportation to the engine assembly plant.

Yet another example system, comprises: a collapsible foam sleeve coupled to an engine passage, the sleeve including four substantially equal sides with rounded corners enclosing an opening and relief cuts in an inner perimeter along each rounded corner. In any preceding example, additionally or optionally, an inner surface of the collapsible foam is in face-sharing contact with an outer wall of the engine passage, the engine passage being an intake air passage. In any or all of the preceding examples, additionally or optionally, the relief cuts include a first cut along the inner perimeter of a first corner with walls of the first cut pinched together, a second cut along the inner perimeter of a second corner with walls of the second cut pinched together, a third cut along the inner perimeter of a third corner with walls of the third cut pinched together, and a fourth cut along the inner perimeter of a fourth corner with walls of the fourth cut pinched together.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system for an engine, comprising:

a collapsible foam sleeve fitted onto an engine passage, the collapsible sleeve including cuts on its surface.

2. The system of claim 1, wherein the foam sleeve is a continuous unitary structure including a first pair of sides and a second pair of sides, the second pair of sides connecting the first pair of sides.

3. The system of claim 1, wherein the foam sleeve is in a more flattened configuration with an elongated cross-section in a collapsed state and wherein the foam sleeve is a hollow cuboid with a substantially rectangular cross-section and rounded corners in an expanded state, a height of the foam sleeve in the collapsed state shorter than a height of the foam sleeve in the expanded state.

4. The system of claim 3, wherein in the collapsed state, the first set of sides include a first long side and a second long side, and the second set of sides include a first short side and a second short side.

5. The system of claim 4, wherein the first long side includes a first pair of crests and a first trough along a width of the first long side and the second long side includes a second pair of crests and a second trough along a width of the second long side.

6. The system of claim 5, wherein one crest of the first pair of crests align with the second trough, and wherein one crest of the second pair of crests align with the first through.

7. The system of claim 4, wherein the cuts include a first V-shaped cut across a width of the first short side and a second V-shaped cut across a width of the second short side, each of the first V-shaped cut and the second V-shaped cut not extending throughout the thickness of the first short side and the second short side, respectively.

8. The system of claim 7, wherein in the expanded state, walls of the first V-shaped cut are pinched together, walls of the second V-shaped cut are pinched together, the first pair of crests are pinched together, and the second pair of crests are pinched together.

9. The system of claim 7, wherein in the expanded state, the first V-shaped cut is positioned at a first rounded corner, the second V-shaped cut is positioned at a second rounded corner, the first pair of crests are positioned at a third rounded corner, and the second pair of crests are positioned at a fourth corner, the first corner being diagonally opposite to the second corner, and the third corner being diagonally opposite to the fourth corner.

10. The system of claim 1, wherein the engine passage is an intake air passage with a cross-section same as that of the sleeve in the expanded state, the sleeve circumferentially surrounding the intake air passage.

11. A method for a foam sleeve, including:

forming the foam sleeve with multiple relief cuts on an outer perimeter;

transporting the foam sleeve in a collapsed state to an engine assembly plant;

repositioning the foam sleeve to form a hollow cuboid by bending regions of the foam that include the relief cuts;

slipping the foam sleeve in the expanded state onto a rectangular frame of an engine passage.

12. The method of claim 11, wherein the relief cuts include each of a first cut across a width of a first side of the foam sleeve, a second cut across a width of a second side of the foam sleeve, a first pair of crests and a first trough along a width of a third side, and a second pair of crests and a second trough along a width of a fourth side.

13. The method of claim 12, wherein in the collapsed state, each of the first cut, the second cut, the first trough, and the second trough are in an open condition, and wherein in the expanded state, each of the first cut, the second cut, the first trough, and the second trough are in a closed condition.

14. The method of claim 13, wherein open condition includes respective walls of each of the first cut, the second cut, the first trough, and the second trough to be separated, and wherein the closed condition includes the respective walls of each of the first cut, the second cut, the first trough, and the second trough to be pinched together.

15. The method of claim 11, wherein the foam sleeve is repositioned from the collapsed state by pulling along the third side of the sleeve away from the fourth side to bend each of the first side, the second side, the third side, and the fourth side.

16. The method of claim 11, wherein the foam sleeve is formed from the block of foam using a jet water jet cutter, a knife, and/or dies.

17. The method of claim 12, further comprising, forming a plurality of foam sleeves from the block of foam and stacking the plurality of foam sleeves during transportation to the engine assembly plant.

18. A system including:

a collapsible foam sleeve coupled to an engine passage, the sleeve including four substantially equal sides with rounded corners enclosing an opening and relief cuts in an inner perimeter along each rounded corner.

19. The system of claim 18, wherein an inner surface of the collapsible foam is in face-sharing contact with an outer wall of the engine passage, the engine passage being an intake air passage.

20. The system of claim 18, wherein the relief cuts include a first cut along the inner perimeter of a first corner with walls of the first cut pinched together, a second cut along the inner perimeter of a second corner with walls of the second cut pinched together, a third cut along the inner perimeter of a third corner with walls of the third cut pinched together, and a fourth cut along the inner perimeter of a fourth corner with walls of the fourth cut pinched together.

* * * * *